US011802427B2

(12) United States Patent
Vršecký

(10) Patent No.: US 11,802,427 B2
(45) Date of Patent: Oct. 31, 2023

(54) DOOR HANDLE ASSEMBLY HAVING AN ADJUSTING MECHANISM FOR A DOOR HANDLE

(71) Applicant: Witte Automotive GmbH, Velbert (DE)

(72) Inventor: Petr Vršecký, Oloví (CZ)

(73) Assignee: Witte Automotive GmbH, Velbert (DE)

( * ) Notice: Subject to any disclaimer, the term of this patent is extended or adjusted under 35 U.S.C. 154(b) by 383 days.

(21) Appl. No.: 17/012,382

(22) Filed: Sep. 4, 2020

(65) Prior Publication Data

US 2021/0071451 A1 Mar. 11, 2021

(30) Foreign Application Priority Data

Sep. 6, 2019 (DE) ..... 102019213566.8
Jul. 28, 2020 (DE) ..... 102020209488.8

(51) Int. Cl.

*E05B 85/10* (2014.01)
*E05B 81/20* (2014.01)
*E05B 85/18* (2014.01)
*E05B 81/76* (2014.01)

(52) U.S. Cl.

CPC ..... *E05B 85/107* (2013.01); *E05B 81/20* (2013.01); *E05B 81/77* (2013.01); *E05B 85/18* (2013.01)

(58) Field of Classification Search

CPC ..... E05C 19/04; Y10T 292/0824; Y10T 292/1021; Y10T 292/1082; Y10T 292/57; E05B 81/20; E05B 85/10; E05B 85/103; E05B 85/107; Y10S 292/31

See application file for complete search history.

(56) References Cited

U.S. PATENT DOCUMENTS 6,076,868 A * 6/2000 Roger, Jr. ..... E05B 81/14 292/216
6,698,262 B2 * 3/2004 Wittwer ..... E05B 77/34 292/DIG. 31
8,919,047 B2 * 12/2014 Johnsrud ..... E05B 85/103 292/336.3
9,605,452 B2 * 3/2017 Yoshino ..... E05B 85/107

(Continued)

FOREIGN PATENT DOCUMENTS

CN 103339334 A 10/2013
CN 105089388 A 11/2015

(Continued)

OTHER PUBLICATIONS

The China National Intellectual Property Administration, Office Action in Application No. CN 202010919555.1, dated Jun. 28, 2021, 7 pages.

*Primary Examiner* — Carlos Lugo
(74) *Attorney, Agent, or Firm* — Marshall & Melhorn, LLC

(57) ABSTRACT

A door handle assembly may have an adjustable door handle having a handle support structure. The assembly may also have an adjusting mechanism for adjusting the door handle between a starting or non-use position and a use position. The adjusting mechanism may have at least one drive unit and a force transfer element which is operatively connected to the handle support structure of the door handle to shift the door handle from the starting or non-use position into the use position or vice versa and which is designed as a roller mechanism.

7 Claims, 8 Drawing Sheets

(56) References Cited

U.S. PATENT DOCUMENTS

| | | | | |
|---|---|---|---|---|
| 10,550,611 | B2 * | 2/2020 | Och | E05B 85/107 |
| 11,332,963 | B2 * | 5/2022 | Karlein | E05B 85/103 |
| 2015/0108773 | A1 | 4/2015 | De Leon Espinal | |
| 2015/0204116 | A1 | 7/2015 | Gramaglia et al. | |
| 2018/0252009 | A1 * | 9/2018 | Porada | E05B 85/103 |
| 2022/0268063 | A1 * | 8/2022 | Vrsecký | E05B 85/107 |

FOREIGN PATENT DOCUMENTS

| | | | | |
|---|---|---|---|---|
| CN | 105672787 | A | 6/2016 | |
| CN | 105917063 | A | 8/2016 | |
| CN | 207212054 | U | 4/2018 | |
| CN | 207553811 | U | 6/2018 | |
| CN | 108360931 | A | 8/2018 | |
| CN | 108779653 | A | 11/2018 | |
| CN | 109790731 | A | 5/2019 | |
| KR | 102007239 | B1 | 8/2019 | |
| WO | WO-2016113339 | A1 * | 7/2016 | E05B 81/82 |

* cited by examiner

DOOR HANDLE ASSEMBLY HAVING AN ADJUSTING MECHANISM FOR A DOOR HANDLE

FIELD

The invention relates to a door handle assembly having an adjusting mechanism.

BACKGROUND

Vehicle doors typically comprise an outer door handle which is mechanically or electrically coupled to a locking mechanism. For example, actuating the door handle moves the locking mechanism from a locked position into an unlocked position in order to allow the vehicle door to be opened. The vehicle door comprises, for example, a door handle in which an outer surface is positioned so as to be approximately flush with an outer surface of an outer vehicle door wall when the door handle is in a non-use position. By means of an adjusting mechanism, the door handle can be moved outward into a use position, such that it can be grasped by a user.

The problem addressed by the present invention is that of providing a door handle assembly having an adjusting mechanism for a door handle that is improved in comparison with the prior art, and a vehicle having a vehicle door and a door handle assembly of this kind having an improved adjusting mechanism.

With regard to the door handle assembly and the vehicle, the problems are solved according to the invention by the features of the claims.

Further developments of the invention are the subject matter of the dependent claims.

SUMMARY

A door handle assembly according to the invention comprises at least one adjustable door handle having a handle support structure and an adjusting mechanism for adjusting the door handle between a non-use or starting position and a use position, the adjusting mechanism comprising at least one drive unit and a force transfer element which is operatively connected to the handle support structure of the door handle in order to shift the door handle from the non-use or starting position into the use position or vice versa and which is designed as a roller mechanism.

A further aspect provides a door handle assembly which comprises an adjusting mechanism, it being possible to shift a door handle from an, in particular lowered, non-use position into an, in particular extended, use position by means of the adjusting mechanism, and the adjusting mechanism comprising at least one drive unit and a force transfer element which is operatively connected to a handle support structure of the door handle in order to shift the door handle and is designed as a roller mechanism which is guided in the handle support structure.

According to one possible embodiment, the adjusting mechanism has at least one pivot bearing or a pivot pin on which the handle support structure and the door handle are arranged, such that they can pivot about a pivot axis.

Furthermore, the handle support structure can comprise at least one holding element which supports the door handle. For example, the handle support structure and the holding element can be designed as one molded part or component, in particular an injection molded part. Alternatively, these can be designed as separate elements.

According to another embodiment, the roller mechanism comprises at least one rolling element. For example, the roller mechanism can comprise at least one guiding roller and at least one or more auxiliary or bearing rollers. The guiding roller is, for example, constantly coupled in a sliding manner to the handle support structure, whereas the auxiliary or bearing rollers are not in contact with the handle support structure, but rather act as support rollers on the stationary bearing element, in particular on a bearing bracket.

In addition, the handle support structure comprises at least one guiding or sliding element, to which the roller mechanism, in particular the guiding roller, is operatively connected, in particular coupled in terms of movement. The guiding or sliding element is designed in particular such that the at least one rolling element, in particular the guiding roller, rolls on the guiding element.

In a further embodiment, the guiding element and the rolling element are operatively connected to one another, such that the rolling element, which rolls on the guiding element, causes the door handle to pivot about the pivot axis.

In addition, the drive unit can be designed as a linear drive unit having an output element on the output side, on which output element the rolling element is arranged. Furthermore, the drive unit can be coupled, by means of signals, to a control unit and a detection unit for detecting an approach of an object to the door handle assembly, the control unit activating and/or triggering the drive unit when an approach of an object is detected at the detection region by the detection unit and/or when an object is detected in the detection region in order to automatically switch the door handle from the non-use or starting position into the use position or vice versa.

A vehicle according to the invention comprises at least one movable element, such as a vehicle door or a hatchback, which comprises the door handle assembly described above, in order to be able to be opened.

In one possible embodiment, the drive unit is designed as a linear drive unit, the force transfer element being provided for transferring and transmitting linear back-and-forth movements, in particular pushing or pulling forces, of the drive unit and for deflecting said linear movements into a movement of the door handle. The linear movement, in particular an extension or retraction movement, of the drive unit is transferred by means of the force transfer element, in particular into a pivoting movement of the door handle.

The adjusting mechanism has, in particular, a pivot axis about which the door handle is movable, in particular pivotable or extendable or retractable, from the non-use position into the use position and vice versa. The pivot axis extends, for example, in parallel with a longitudinal axis of a vehicle when the door handle is arranged on a side door of the vehicle. The handle support structure of the door handle is mounted on a vehicle body, such that it can pivot about the pivot axis. The handle support structure of the door handle is formed, for example, from two holding bars, in particular L-shaped or sickle-shaped holding bars, which are connected to the door handle. The holding bars are connected to one another, for example, by means of a connecting bar. The connecting bar is designed in particular as a guiding or sliding element for the roller mechanism. For example, the connecting bar is designed as a sliding rail, sliding rib or sliding bar, a guiding profile, a sliding profile, a roller sliding rail or bar, a telescopic rail, a roller rail or bar, a ball roller rail and/or a ball bearing rail for rolling the roller mechanism on said connecting bar.

According to one embodiment, the roller mechanism has the at least one guiding roller which, when the door handle is adjusted by means of the drive unit, rolls on the handle support structure, in particular the guiding element, for example the connecting bar. The guiding roller and the guiding element, such as the connecting bar, are operatively connected, in particular coupled in terms of movement, such that the guiding roller, which rolls on the guiding element, such as the connecting bar, causes a pivoting movement of the door handle about the pivot axis. For this purpose, the guiding roller rests on a rear face of the holding element that is firmly connected to the door handle, in particular the connecting bar thereof, which is not visible to the user.

The drive unit is arranged in particular between the holding bars of the handle support structure. This allows a compact design of the adjusting mechanism.

The drive unit is in particular a linear drive device which is designed, for example, as an electrical output rod or push rod. For example, the drive unit comprises an electric motor or a hydraulic pump, an output element, such as an output rod or push rod, being provided on the output side, which output element is moved linearly back and forth when the drive unit is active. The force transfer element is connected to the output rod at an end of the output rod facing away from the drive unit.

Furthermore, the drive unit is coupled to the control unit, in particular coupled by means of signals. The control unit can in turn be connected to the detection unit, which is, for example, a capacitive detection unit. In particular, the detection unit detects an approach of an object into a detection region, the control unit activating and/or triggering the drive unit after the object has been successfully identified and/or authenticated in order to automatically switch the door handle from the non-use position into the use position. In other words: If an authenticated user approaches a vehicle door in which the door handle is in the lowered non-use position, said door handle is automatically extended into the use position by triggering the drive unit.

According to a further embodiment, the roller mechanism can additionally have at least one bearing roller which is slidably supported against a holding structure that is fixed to the body. The bearing roller does not lie on the holding element, in particular on the connecting bar, but rather on the holding structure that is fixed to the body, such that said bearing roller is supported in rotation along a surface of the holding structure. The holding structure is designed, for example, as a bearing support structure, in particular a stationary bearing bracket of the door handle.

In one possible embodiment, the roller mechanism comprises the at least one guiding roller for transferring movement from the drive unit to the door handle and at least two bearing rollers for supporting the adjusting mechanism. The guiding roller and the bearing rollers are each guided in different guiding or sliding elements or slots. For example, the guiding roller is guided in a guiding groove or slot along the connecting bar. The bearing rollers are guided in different guiding grooves or slots along the vehicle body and/or handle support structure or are supported in a rolling manner. The guiding grooves and/or slots are in particular straight. Alternatively, these can also be designed in the shape of a curve, an arc, or a partial circular arc. The guiding grooves or slots are formed in one piece together with the handle support structure and/or the vehicle body, in particular a door panel or another holding structure that is fixed to the body. Alternatively, these can be bonded to the handle support structure and/or the vehicle body, in particular a door panel or another holding structure that is fixed to the body.

The force transfer element and the connecting bar, in particular the guiding roller and the guiding groove or slot, are designed such that the connecting bar and thus the door handle firmly connected thereto are deflected, in particular pivoted, at an angle of 15° to 90°, preferably 35° to 75°, particularly preferably 25° to 45°, in relation to the direction of the linear adjustment movement of the drive unit.

The advantages achieved by means of the invention are, in particular, that the door handle of a door handle assembly having an adjusting mechanism of this kind, which adjusting mechanism has a roller mechanism as a force transfer element, can be adjusted in a simple manner by means of the greatest possible application of force from the non-use or starting position into the use position.

BRIEF DESCRIPTION OF THE FIGURES

Exemplary embodiments of the invention are explained in greater detail with reference to drawings, in which.

Corresponding parts are provided with the same reference numerals in all figures.

DESCRIPTION

Figure 1:
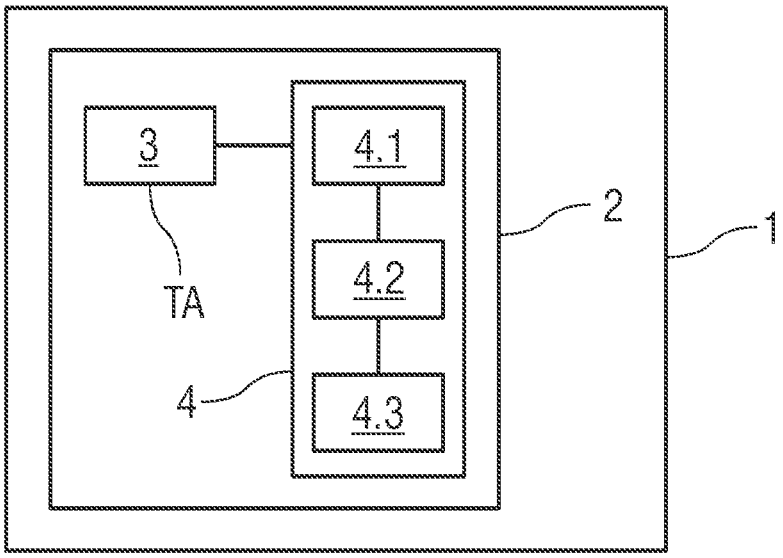
FIG. 1 is a schematic view of a block diagram of a vehicle having a door handle.

FIG. 1 is a block diagram of a vehicle 1.

The vehicle 1 comprises a vehicle door 2 having a door handle assembly TA comprising a door handle 3 which can be extended from an initial or non-use position P1 into a use position P2 by means of an adjusting mechanism 4.

In the non-use position P1, the door handle 3 is arranged, in particular lowered, in a recess made in the vehicle door 2, such that the door handle 3 complements an outer contour of the vehicle door 2, in particular ends flush therewith. In order to operate the door handle 3, it can be moved, in particular extended or pivoted, from the non-use position P1 (see e.g. FIG. 7) into the use position P2 (see e.g. FIG. 8), in which it can be actuated by a user.

The adjusting mechanism 4 comprises a drive unit 4.1 and a control unit 4.2 which is provided for triggering the drive unit 4.1. According to the exemplary embodiment shown, the control unit 4.2 is connected to a detection unit 4.3 which comprises, for example, a capacitive sensor. The detection unit 4.3 detects, in particular, an approach of an object authorized to open the vehicle door 2 into a detection region, the control unit 4.2 activating and/or triggering the drive unit 4.1 after the object has been successfully identified and/or authenticated in order to switch the door handle 3 from the non-use position P1 into the use position P2. The door handle 3 is automatically extended into the use position P2 by means of the adjusting mechanism 4. The door handle 3 can be lowered from the use position P2 into the non-use position P1 automatically after a predetermined period of time or after another actuation of the door handle 3.

Figure 2:
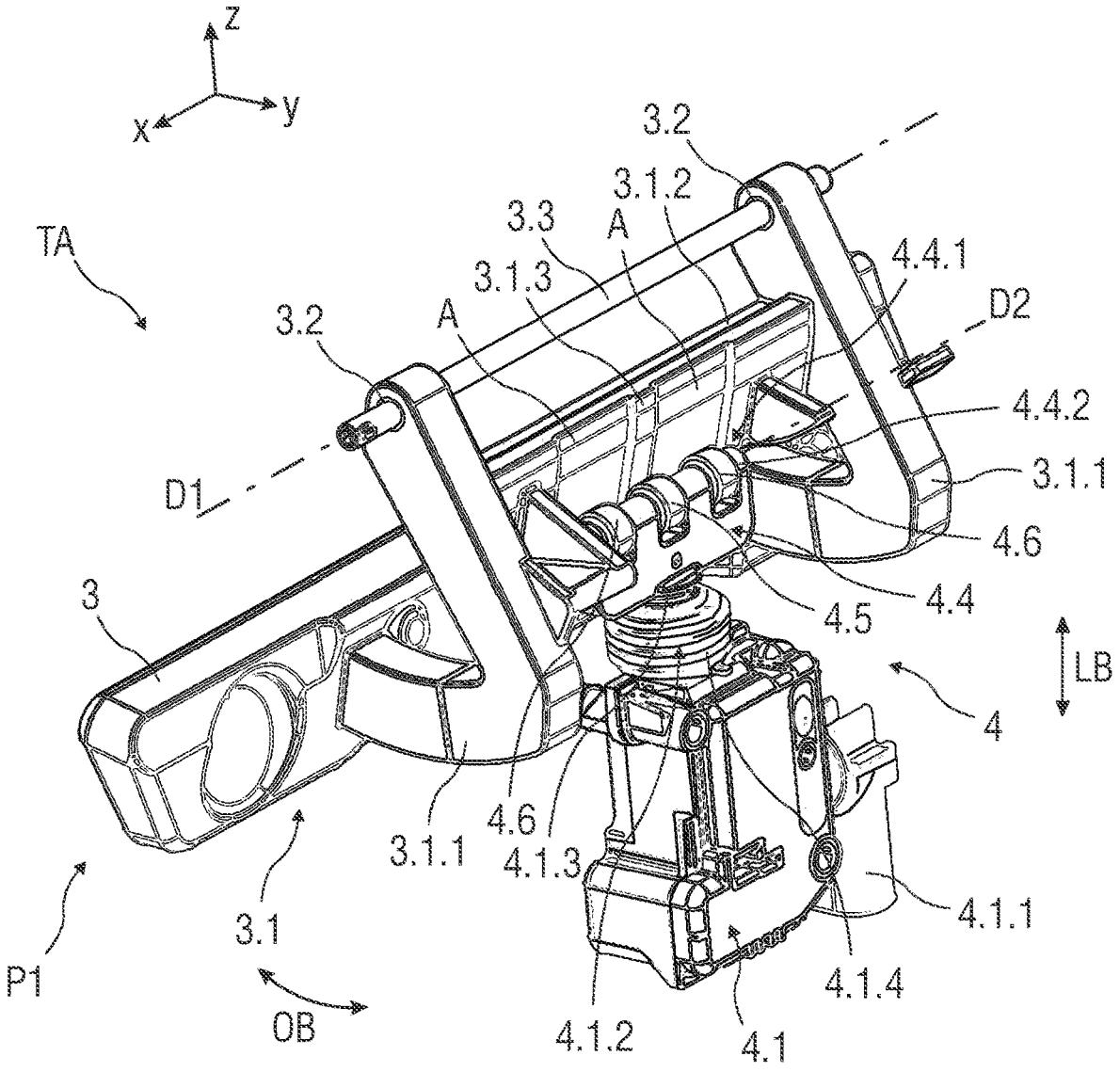
FIGS. 2 to 5 are schematic perspective views of an adjusting mechanism for the door handle.
Figure 3:
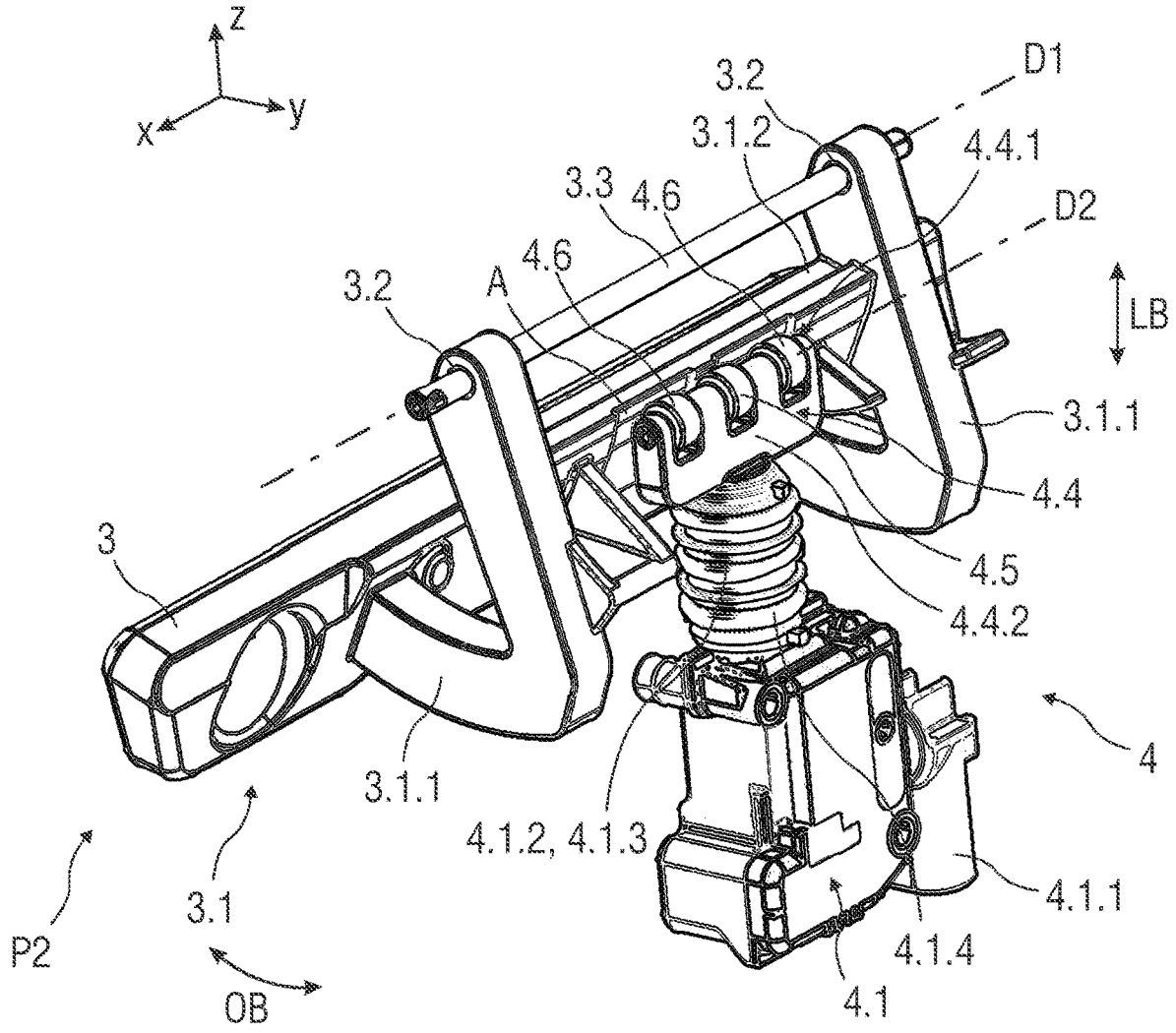
Figure 4:
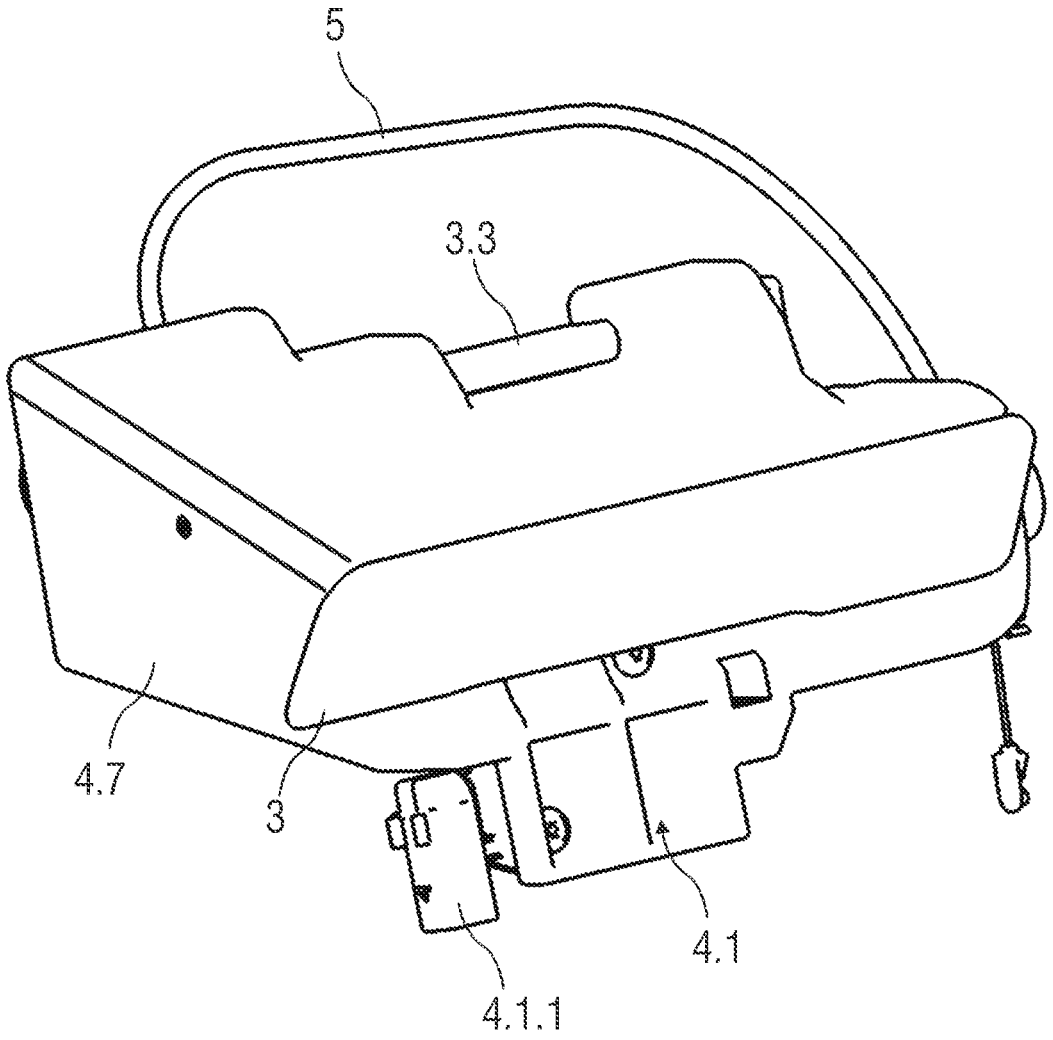
Figure 5:
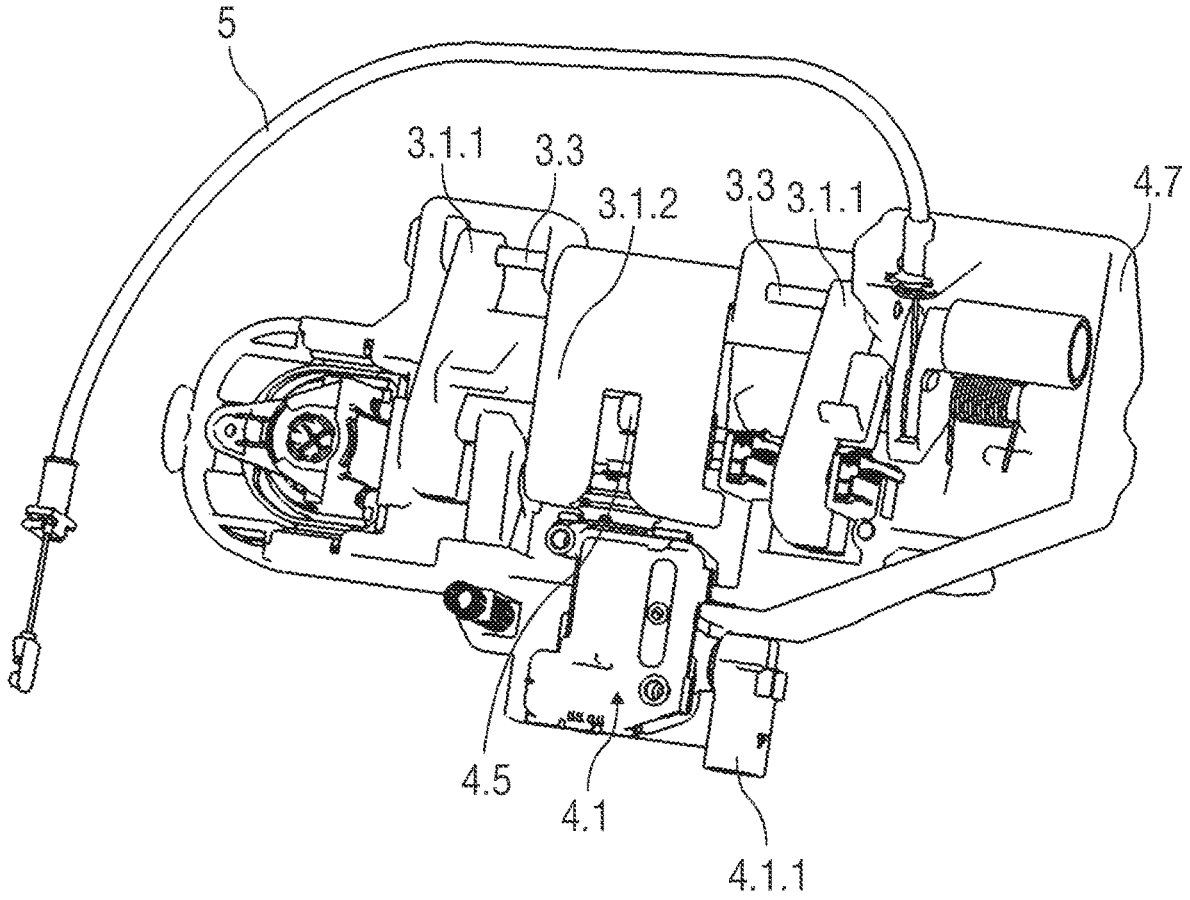
Figure 6:
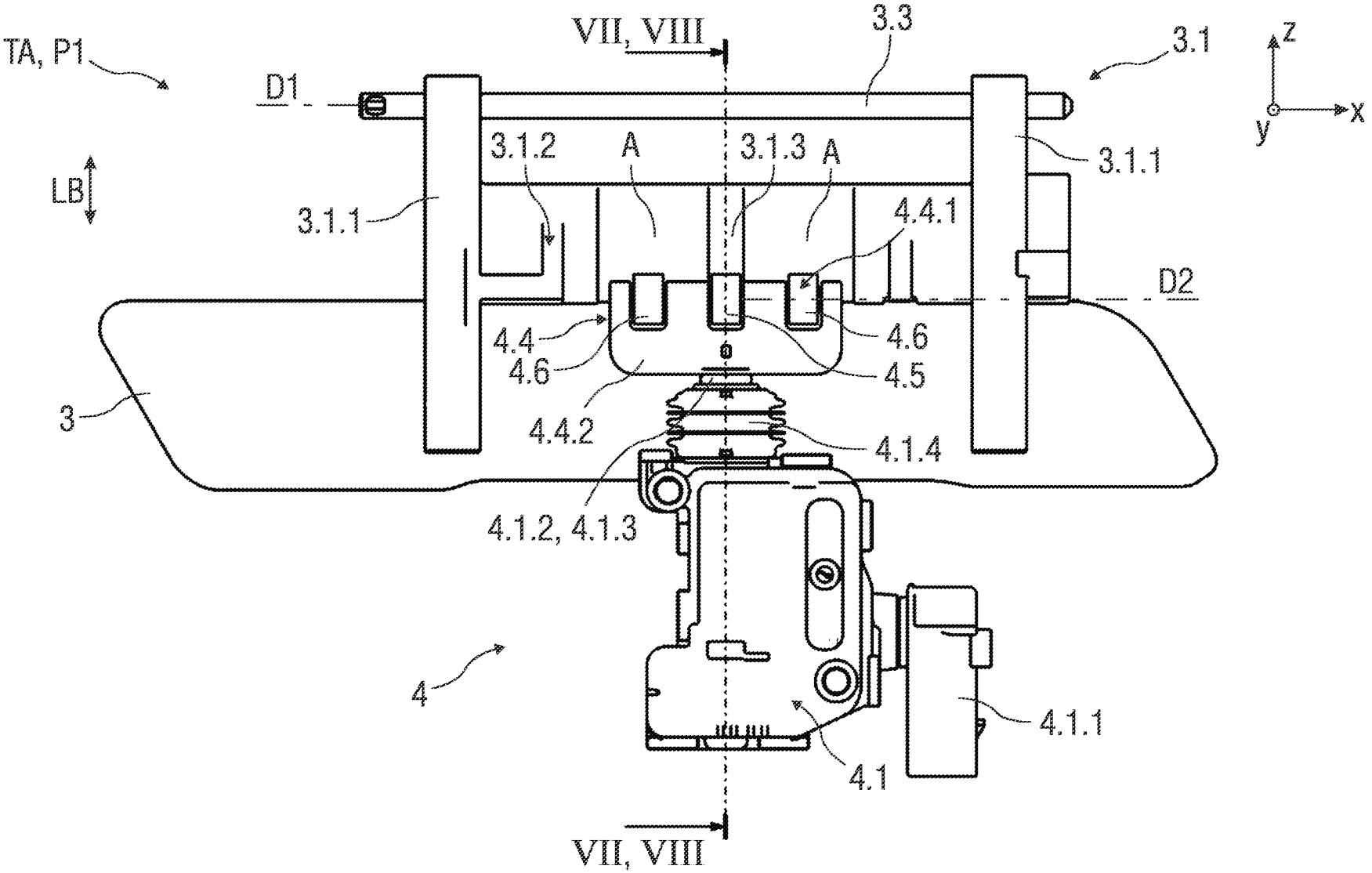
FIG. 6 is a schematic rear view of the adjusting mechanism.
Figure 7:
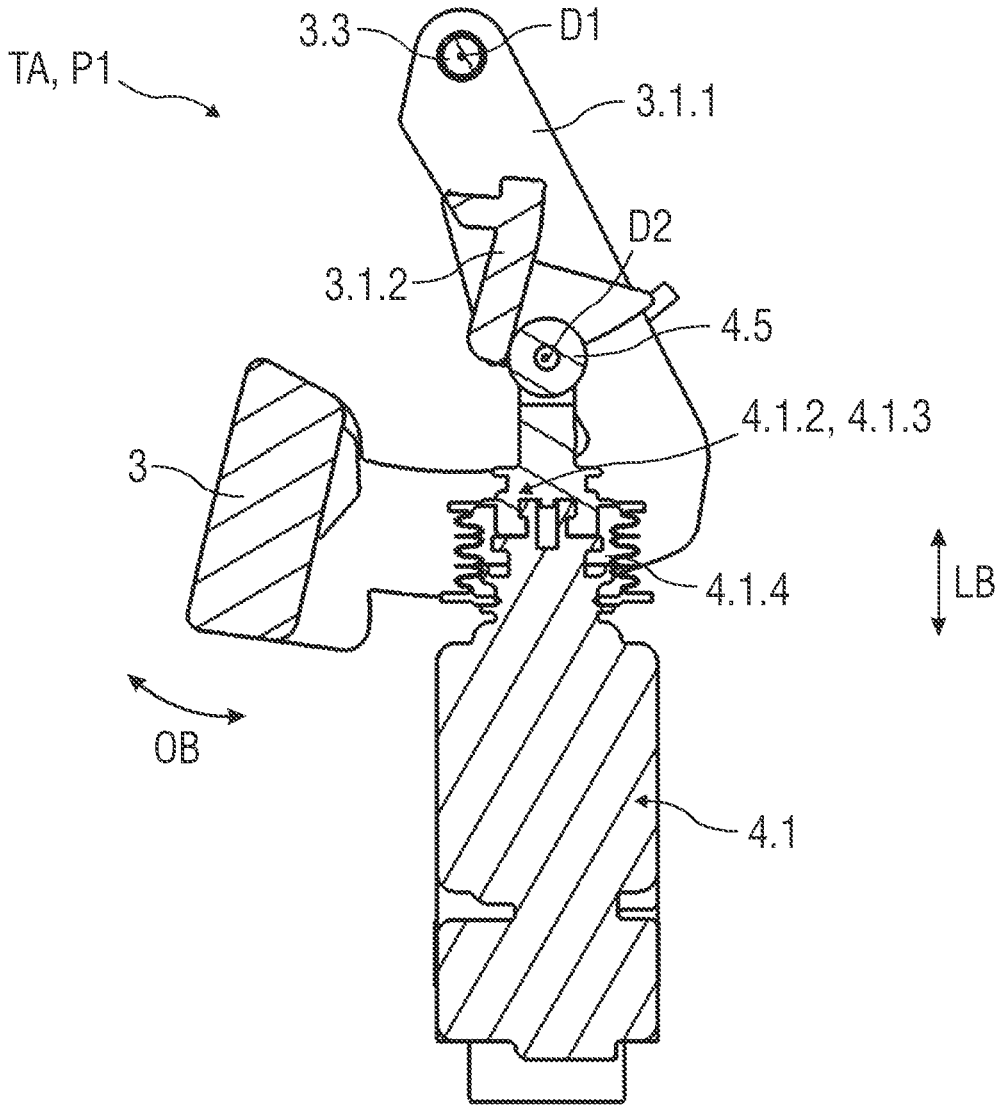
FIG. 7 is a schematic sectional view of the adjusting mechanism with the door handle in a non-use position.
Figure 8:
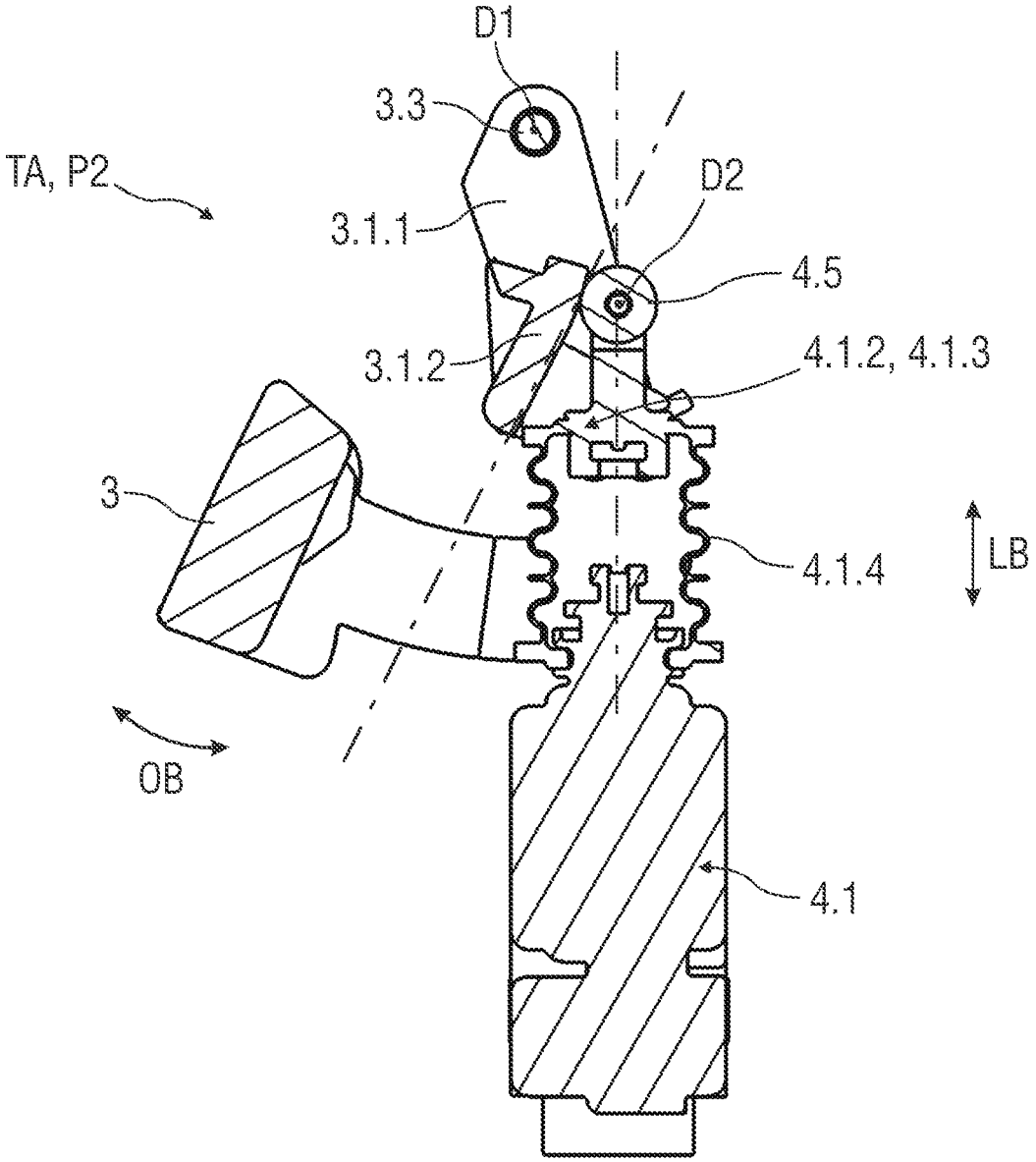
FIG. 8 is a schematic sectional view of the adjusting mechanism with the door handle in a use position.

The following FIGS. 2 to 8 are different views of the adjusting mechanism 4 in more detail. In particular, FIGS. 2 to 5 are schematic perspective views of the adjusting mechanism 4, FIG. 2 being a perspective rear view of the adjusting mechanism 4 with the door handle 3 in the non-use position P1. FIG. 3 is a perspective rear view of the adjusting mechanism 4 with the door handle 3 in the use position P2. FIG. 4 is a perspective front view of the adjusting mechanism 4 with the door handle 3 in the non-use position P1. FIG. 5 is a further perspective rear view of the adjusting mechanism 4 with the door handle 3 in the non-use position P1. FIG. 6 is a rear view of the adjusting mechanism 4 with the door handle 3 in the non-use position P1. FIG. 7 is a sectional illustration, in particular a longitudinal section, of the adjusting mechanism 4 with the door handle 3 in the non-use position P1. FIG. 8 is a sectional illustration, in particular a longitudinal section, of the adjusting mechanism 4 with the door handle 3 in the use position P2.

As shown in FIGS. 2 and 3, the adjusting mechanism 4 comprises the at least one drive unit 4.1 and a force transfer element 4.4 which is operatively connected to a handle support structure 3.1 of the door handle 3 in order to shift the door handle 3 and is designed as a roller mechanism 4.4.1 which is guided on the door handle 3, in particular in the handle support structure 3.1.

The adjusting mechanism 4 also has a rotational or pivot axis D1, about which the door handle 3 can be moved, in particular pivoted or extended or retracted, from the non-use position P1 into the use position P2 or vice versa. The pivot axis D1 extends, for example, in parallel with a longitudinal axis X of the vehicle 1 when the door handle 3 is arranged on a side door of the vehicle 1.

In detail, the handle support structure 3.1 of the door handle 3 is mounted so as to pivot about the pivot axis D1 on a vehicle body of the vehicle 1. The handle support structure 3.1 is formed, for example, from two holding bars 3.1.1, in particular L-shaped or sickle-shaped holding bars, which are firmly connected to the door handle 3. The two holding bars 3.1.1 are spaced apart from one another in the direction of the longitudinal axis X and are connected to one another by means of a connecting bar 3.1.2. The connecting bar 3.1.2 is designed in particular as a guiding or sliding element for the roller mechanism 4.4.1. For example, the connecting bar 3.1.2 is designed as a sliding rail or bar, a guiding profile, a sliding profile, a roller sliding rail or bar, a telescopic rail, a roller rail or bar, a ball roller rail and/or a ball bearing rail for rolling the roller mechanism 4.4.1 on said connecting bar 3.1.2. The door handle 3 and its handle support structure 3.1 are mounted so as to be movable about the pivot axis D1 relative to the vehicle body.

The adjusting mechanism 4 comprises the drive unit 4.1, which is in particular fixed to the vehicle, and the force transfer element 4.4 which can be moved relative to the drive unit 4.1, to the vehicle body, and to the door handle 3. The drive unit 4.1 is arranged in particular between the holding bars 3.1.1 of the handle support structure 3.1.

The drive unit 4.1 is designed in particular as a linear drive unit. The force transfer element 4.4 is provided for transferring and transmitting linear back-and-forth movements, in particular pushing or pulling forces, of the drive unit 4.1, and deflecting said linear movements LB into a movement, in particular an opening or closing movement OB, of the door handle 3. The linear movement LB, in particular a vertical extension or retraction movement in the direction of a vertical axis Z, of the drive unit 4.1 is transferred into the opening or closing movement OB, in particular into a pivoting movement of the door handle 3, by means of the force transfer element 4.4.

For example, a free end of the handle support structure 3.1 is rotatably mounted on the pivot axis D1. For this purpose, the free ends of the holding bars 3.1.1 facing away from the door handle 3, have through-openings 3.2 by means of which the handle support structure 3.1 is mounted on a bearing element 3.3 so as to rotate about the pivot axis D1. The handle support structure 3.1 is firmly connected to the door handle 3 by means of the ends of the holding bars 3.1.1 facing the door handle 3. In particular, this end of the handle support structure 3.1 is firmly connected to a rear face of the door handle 3 that is not visible to a user.

When the door handle 3 is automatically moved into the use position P2, the handle support structure 3.1 is pivoted about the pivot axis D1, the door handle 3 firmly connected to the handle support structure 3.1 also being pivoted about the pivot axis D1.

The part of the adjusting mechanism 4 that is fixed to the body is firmly connected to the vehicle 1, such that, when the door handle 3 is extended, the extendable part is moved relative to the part that is fixed to the body. The part of the adjusting mechanism 4 that is fixed to the body comprises the drive unit 4.1. The roller mechanism 4.4.1 can comprise several rollers for converting or transferring the linear movement LB into the opening and closing movement OB and/or for support.

In particular, the roller mechanism 4.4.1 comprises at least one guiding roller 4.5 and two outer bearing rollers 4.6.

The part that is fixed to the body also comprises the control unit 4.2 and the detection unit 4.3, which are, however, not shown in FIGS. 2 to 8.

When the door handle 3 is adjusted, for example, into the use position P2, the at least one guiding roller 4.5 rolls on the handle support structure 3.1, in particular the connecting bar 3.1.2. The guiding roller 4.5 and the connecting bar 3.1.2 are operatively connected, in particular coupled in terms of movement, such that the guiding roller 4.5 rolling on the connecting bar 3.1.2 effects an opening or pivoting movement of the door handle 3 about the pivot axis D1. For this purpose, the guiding roller 4.5 rests against a rear face of the connecting bar 3.1.2 that is firmly connected to the door handle 3.

The drive unit 4.1 is in particular a linear drive device which is designed, for example, as an electrical output rod or push rod. For example, the drive unit 4.1 comprises an electric motor 4.1.1 and, on the output side, an output element 4.1.2 which, when the drive unit 4.1 is active, is moved linearly back and forth according to the linear movement LB. At an end of the output element 4.1.2 facing away from the drive unit 4.1, the force transfer element 4.4 is connected to the output element 4.1.2.

The force transfer element 4.4 comprises a bearing structure 4.4.2 on which the guiding roller 4.5 and/or the bearing rollers 4.6 are rotatably mounted.

The output element 4.1.2 on the output side is designed in particular as an output rod 4.1.3, for example a push rod or pull rod. The output rod 4.1.3 can be covered by means of a cover element 4.1.4. The cover element 4.1.4 is in particular tubular and/or formed from an elastic material, such as rubber. Elasticity is also promoted by the fact that the cover element 4.1.4 can be folded up like an accordion when in the non-use position P1.

In the exemplary embodiment shown, the guiding roller 4.5 and the bearing rollers 4.6 are mounted in a common plane in the bearing structure 4.4.2 so as to rotate about a rotational axis D2. The rotational axis D2 extends, for example, in parallel with the longitudinal axis X of the vehicle 1 when the door handle 3 is arranged on a side door of the vehicle 1.

The rollers—the guiding roller 4.5 and the bearing rollers 4.6—are arranged between the holding bars 3.1.1 and so as to face a rear face of the connecting bar 3.1.2. The rollers—guiding roller 4.5 and bearing rollers 4.6—are arranged next to one another and spaced apart from one another along the longitudinal axis X.

A contact surface of the guiding roller 4.5 is in contact with the back of the connecting bar 3.1.2. For example, the connecting bar 3.1.2 has a guiding bar 3.1.3 in the contact region with the guiding roller 4.5. The guiding bar 3.1.3 protrudes from the surface of the connecting bar 3.1.2 in relation to adjacent regions in order to allow a secure contact between the guiding roller 4.5 and the guiding bar 3.1.3.

Furthermore, the rear face of the connecting bar 3.1.2 has two material recesses A. The material recesses A serve to prevent contact of the bearing rollers 4.6 with the extendable part of the adjusting mechanism 4, in particular with the rear face of the connecting bar 3.1.2.

The bearing rollers 4.6 are in contact with a holding structure 4.7 (see FIG. 4) associated with the part that is fixed to the body, a contact surface of the bearing rollers 4.6 being in contact with a surface of the holding structure 4.7, which is designed in particular as a so-called bearing support structure. The bearing rollers 4.6 are in contact with the holding structure 4.7, such that said bearing rollers rotate along the surface of the holding structure 4.7 and are supported against said holding structure. The extendable part of the adjusting mechanism 4, in particular the output element 4.1.2 and the force transfer element 4.4, is supported against the part that is fixed to the body by means of the bearing rollers 4.6.

When the drive unit 4.1 is triggered, the output element 4.1.2, in particular the output rod 4.1.3, together with the cover element 4.1.4 are moved upward along the vertical axis Z. In particular, the cover element 4.1.4 is pulled apart like an accordion in the direction of the vertical axis Z (see FIG. 8), which results in an upward movement of the force transfer element 4.4 and in particular the bearing structure 4.4.2. The guiding roller 4.5 rotates along the rear face of the connecting bar 3.1.2, in particular on the guiding bar 3.1.3, upward in the direction of the vertical axis Z.

The pushing force of the output element 4.1.2 and thus the linear movement LB thereof upward is transferred into an opening movement, in particular a rotational force and resulting in a pivoting movement, of the handle support structure 3.1 firmly connected to the door handle 3, such that said handle support structure is pivoted about the pivot axis D1. To adjust the door handle 3 into the use position P2 (see FIG. 3), the handle support structure 3.1 is pivoted clockwise about the pivot axis D1. When the door handle 3 is in the use position P2, the vehicle door 2 can be opened, for example, with the aid of a Bowden cable 5 shown in FIGS. 4 and 5.

To retract or lower the door handle 3 back into the non-use position P1 (see FIG. 2), the handle support structure 3.1 is pivoted counterclockwise about the pivot axis D1. The output element 4.1.2 is moved downward along the vertical axis Z, which results in a downward movement of the force transfer element 4.4 and in particular the bearing structure 4.4.2 thereof. As a result, the cover element 4.1.4 is folded up like an accordion in the direction of the vertical axis Z (see FIG. 7). The guiding roller 4.5 rotates along the rear face of the connecting bar 3.1.2 on the guiding bar 3.1.3 downward in the direction of the vertical axis Z. The now occurring tensile force of the output element 4.1.2 and thus the linear movement LB thereof downward is transferred into a closing movement, in particular a rotational force and resulting in a pivoting movement, of the handle support structure 3.1 firmly connected to the door handle 3, such that said handle support structure is pivoted back counterclockwise about the pivot axis D1.

By means of the adjusting mechanism 4 described, the door handle 3 can be adjusted into the use position P2 in a simple manner and with the greatest possible application of force.

LIST OF REFERENCE NUMBERS

1 Vehicle
2 Vehicle door
3 Door handle
3.1 Handle support structure
3.1.1 Holding bars
3.1.2 Connecting bar
3.1.3 Guiding bar
3.2 Through-opening
3.3 Bearing element
4 Adjusting mechanism
4.1 Drive unit
4.1.1 Electric motor
4.1.2 Output element
4.1.3 Output bar
4.1.4 Cover element
4.2 Control unit
4.3 Detection unit
4.4 Force transfer element
4.4.1 Roller mechanism
4.4.2 Bearing structure
4.5 Guiding roller
4.6 Bearing roller
4.7 Holding structure
5 Bowden cable
A Material recess
D1 Pivot axis
D2 Rotational axis
LB Linear movement
OB Opening or closing movement
P1 Non-use position
P2 Use position
TA Door handle assembly
X Longitudinal axis
Z Vertical axis

The invention claimed is:

1. A door handle assembly, comprising:

a door handle having a handle support structure; and an adjusting mechanism for adjusting the door handle between a starting or non-use position and a use position, wherein the adjusting mechanism comprises a linear drive unit and a force transfer element which is operatively connected to the handle support structure of the door handle in order to shift the door handle from the starting or non-use position into the use position or vice versa and which is designed as a roller mechanism, wherein the handle support structure comprising a backside guiding surface spanning between two holding bars attached to a rear surface of the handle, a guiding bar protruding from the backside guiding surface defining a surface on which the roller mechanism rolls on, and wherein the adjusting mechanism is located between the two holding bars, having the roller mechanism moving between an upward direction, when shifting the door handle from the starting or non-use position into the use position, and a lower position, shifting the door handle from the use position into the starting or non-use position.

2. The door handle assembly according to claim 1, wherein the roller mechanism rolls on the backside guiding surface during pivot movement of the door handle about a pivot axis.

3. The door handle assembly according to claim 1, wherein the handle support structure comprises a holding element, including the two holding bars, which supports the door handle.

4. The door handle assembly according to claim 1, wherein the roller mechanism comprises a rolling element.

5. The door handle assembly according to claim 4, wherein the drive unit has an output element on the output side, on which output element the rolling element is arranged.

6. The door handle assembly according to claim 1, wherein the drive unit signals a control unit and a detection unit for detecting an approach of an object at the door handle assembly, the control unit activating and/or triggering the drive unit when an approach of an object is detected at the detection region of the detection unit by the detection unit and/or when an object is detected in the detection region in order to automatically switch the door handle from the non-use or starting position into the use position or vice versa.

7. A vehicle having at least one movable element which comprises a door handle assembly according to claim 1.

* * * * *